US011391052B2

(12) United States Patent
Lamm et al.

(10) Patent No.: US 11,391,052 B2
(45) Date of Patent: Jul. 19, 2022

(54) CONCRETE FORM BRACE WITH MULTI-DEPTH REBAR POSITIONING

(71) Applicants: Dwight Lamm, Bigfork, MT (US); Darryl Byle, Bigfork, MT (US)

(72) Inventors: Dwight Lamm, Bigfork, MT (US); Darryl Byle, Bigfork, MT (US)

( * ) Notice: Subject to any disclaimer, the term of this patent is extended or adjusted under 35 U.S.C. 154(b) by 0 days.

(21) Appl. No.: 16/748,215

(22) Filed: Jan. 21, 2020

(65) Prior Publication Data

US 2020/0232219 A1 Jul. 23, 2020

Related U.S. Application Data

(60) Provisional application No. 62/795,382, filed on Jan. 22, 2019.

(51) Int. Cl.

| | |
|---|---|
| ***E04G 17/12*** | (2006.01) |
| ***E04G 17/06*** | (2006.01) |
| ***E04G 17/14*** | (2006.01) |
| ***E04C 5/16*** | (2006.01) |

(52) U.S. Cl.

CPC ..... *E04G 17/12* (2013.01); *E04C 5/16* (2013.01); *E04C 5/168* (2013.01); *E04G 17/14* (2013.01)

(58) Field of Classification Search

CPC ..... E04G 17/12; E04G 17/064; E04G 17/14; E04C 5/16; E04C 5/168; E04C 5/18; E04C 5/205; E04C 5/206

USPC ..... 249/34; 52/293.1, 426

See application file for complete search history.

(56) References Cited

U.S. PATENT DOCUMENTS

| | | | | |
|---|---|---|---|---|
| 5,625,989 A * | 5/1997 | Brubaker | E04B 2/54 | 249/40 |
| 5,657,600 A * | 8/1997 | Mensen | E04C 1/40 | 52/426 |
| 5,937,604 A * | 8/1999 | Bowron | E04G 21/185 | 248/229.16 |
| 6,113,060 A * | 9/2000 | Wilde | E04C 5/168 | 249/213 |
| 6,314,694 B1 * | 11/2001 | Cooper | E04B 2/8611 | 249/190 |

(Continued)

FOREIGN PATENT DOCUMENTS

| | | | | |
|---|---|---|---|---|
| AU | 2011100196 * | 3/2011 | E04C 5/205 | |
| EP | 1118730 A1 * | 7/2001 | E04C 5/20 | |

(Continued)

*Primary Examiner* — Michael Safavi

(74) *Attorney, Agent, or Firm* — Mitchell J.W. Vap

(57) ABSTRACT

The described Concrete Form Brace With Multi-Depth Rebar Positioning is comprised of opposing attachment members, which secure the brace to the concrete form elements. The attachment members have a first top end, and a second bottom end. The corresponding bottom ends of the attachment members are connected by a spanning element, which spans the width of the concrete form. The attachment members and spanning element are further connected by a plurality of reinforcing struts. Rebar attachment means at multiple vertical depths within the concrete form are integrated or connected to the reinforcing struts to provide rebar securement means at multiple depths within the poured concrete. The preferred embodiment also features vertical spacing between horizontally placed rebar to accommodate "L" shaped vertical rebar placement for applications where vertical rebar is specified.

4 Claims, 4 Drawing Sheets

(56) References Cited

U.S. PATENT DOCUMENTS

| | | | | |
|---|---|---|---|---|
| 6,536,172 | B1 * | 3/2003 | Amend | E04B 2/8617 249/213 |
| 6,792,729 | B2 * | 9/2004 | Beliveau | E04B 2/8617 52/279 |
| 7,818,925 | B2 * | 10/2010 | Benedict | E02D 27/02 52/169.5 |
| 8,037,652 | B2 * | 10/2011 | Marshall | E04B 2/8635 52/309.11 |
| 8,646,746 | B2 * | 2/2014 | Boese | E04G 13/00 249/216 |
| 10,570,632 | B1 * | 2/2020 | Hartman | E04G 17/14 |
| 2002/0092253 | A1 * | 7/2002 | Beliveau | B29C 44/1271 52/426 |
| 2005/0023432 | A1 * | 2/2005 | Huber | E04G 21/185 249/34 |
| 2005/0055984 | A1 * | 3/2005 | Huber | E04C 5/168 52/782.1 |
| 2006/0059846 | A1 * | 3/2006 | Rice | E04B 5/10 52/702 |
| 2008/0209843 | A1 * | 9/2008 | Helms | E04C 5/205 52/677 |
| 2014/0331592 | A1 * | 11/2014 | Lawrence | E04C 5/167 52/677 |
| 2017/0121988 | A1 * | 5/2017 | McDonagh | E04G 17/0758 |
| 2020/0040581 | A1 * | 2/2020 | Paulger | E04C 5/168 |
| 2020/0407987 | A1 * | 12/2020 | Vitale, Jr. | E04C 5/205 |

FOREIGN PATENT DOCUMENTS

| | | | | |
|---|---|---|---|---|
| EP | 1688551 | * | 8/2006 | E04B 1/4107 |
| EP | 2963205 | A1 * | 1/2016 | E04C 5/168 |

* cited by examiner

CONCRETE FORM BRACE WITH MULTI-DEPTH REBAR POSITIONING

CROSS-REFERENCE TO RELATED APPLICATIONS

This is a Non-provisional application, which claims priority from U.S. Provisional Application No. 62/795,382 filed on Jan. 22, 2019, the disclosure of which is incorporated by reference in its entirety to provide continuity of disclosure.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO SEQUENCE LISTING, A TABLE, OR A COMPUTER PROGRAM LISTING COMPACT DISC APPENDIX

Not applicable.

BACKGROUND OF THE INVENTION

The invention disclosed herein generally relates to concrete construction, particularly concrete form bracing. This invention provides accurate spacing between concrete form members and a convenient means to position rebar at multiple depths within the poured concrete and at optimal vertical spacing for "L" vertical rebar tie in.

In modern construction, reinforced concrete is often specified for the construction of building foundation footings. Footings are typically constructed by forming the specified footing below the frostline with forming elements. Form elements are usually comprised of dimensional lumber units, or dedicated steel concrete forms, which are connected in a means to form the inside and outside perimeter of the specified footing. The form elements are usually secured together by various means to maintain a consistent distance between the form elements. There are many concrete form bracing and/or spacing options that exist in the art.

Rebar, or other reinforcing material is generally placed within the form prior to the concrete being poured. Rebar functions to add strength to concrete due to its high tensile strength. Rebar installation parameters and coverage specifications generally call for accurate rebar placement to maximize the effectiveness of the rebar. Improperly placed rebar, or rebar outside of coverage tolerances can detrimentally impact the strength of the concrete structure. Therefore, it is critical to accurately place rebar within the concrete structure to maximize the rebar's effectiveness. Rebar can be specified for both horizontal and vertical placement; therefore, it would be advantageous to have a convenient means of bracing concrete forms, which also incorporate rebar placement and securement means.

Various concrete form braces in the art have rebar attachment means. However, the prior art lacks concrete form bracing options, which also provide a convenient means to secure rebar at multiple depths within poured concrete. Furthermore, the prior art lacks concrete form bracing options, which provide a means to secure horizontal rebar at optimal vertical depths for accurate "L" shaped vertical rebar securement.

Applicant's invention provides a means to secure rebar at multiple depths by utilizing a system of struts within the brace coupled with integrated "U" shaped saddle rebar securing mechanisms. The use of struts increases the rigidity of the overall concrete brace, while providing the means for multi-depth horizontal rebar securement and accurate "L" shaped vertical rebar securement.

All patents, patent applications, provisional patent applications and publications referred to or cited herein, are incorporated by reference in their entirety to the extent they are not inconsistent with the teachings of the specification.

BRIEF SUMMARY OF THE INVENTION

The described concrete form brace with multi-depth rebar positioning is comprised of opposing attachment members, which secure the brace to the concrete form elements. The attachment members have a first top end, and a second bottom end. The corresponding bottom ends of the attachment members are connected by a spanning element, which spans the width of the concrete form. The attachment members and spanning element are further connected by a plurality of reinforcing struts. Rebar attachment means at multiple vertical depths within the concrete form are integrated or connected to the reinforcing struts to provide rebar securement means at multiple depths within the poured concrete.

The preferred embodiment also features vertical spacing between horizontally placed rebar to accommodate "L" hook vertical rebar placement for applications where vertical rebar is specified.

DETAILED DESCRIPTION OF THE INVENTION

Figure 1:
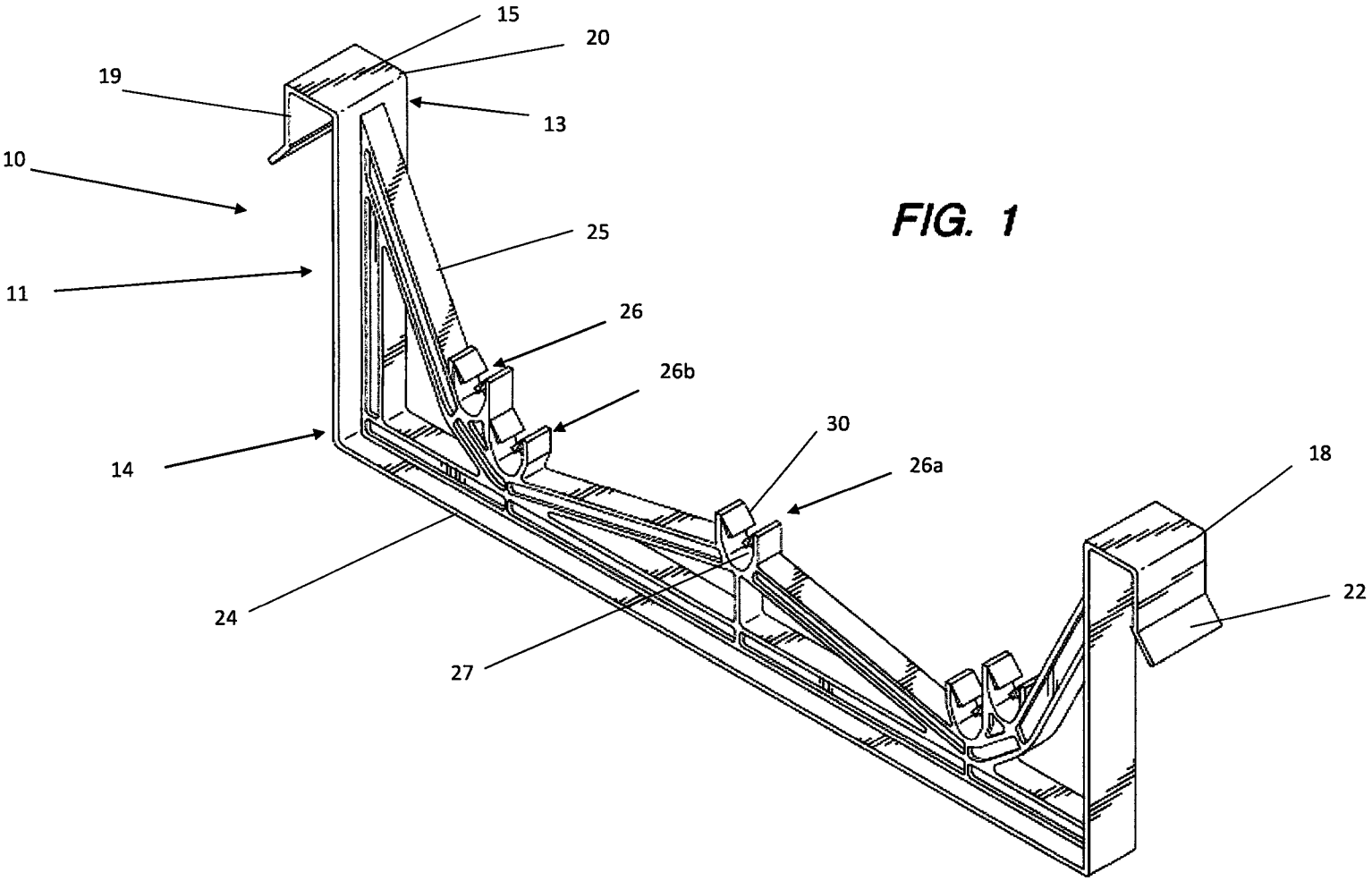
FIG. 1 is an elevated perspective view of the preferred embodiment of the Concrete Form Brace with Multi-Depth Rebar Positioners.
Figure 2:
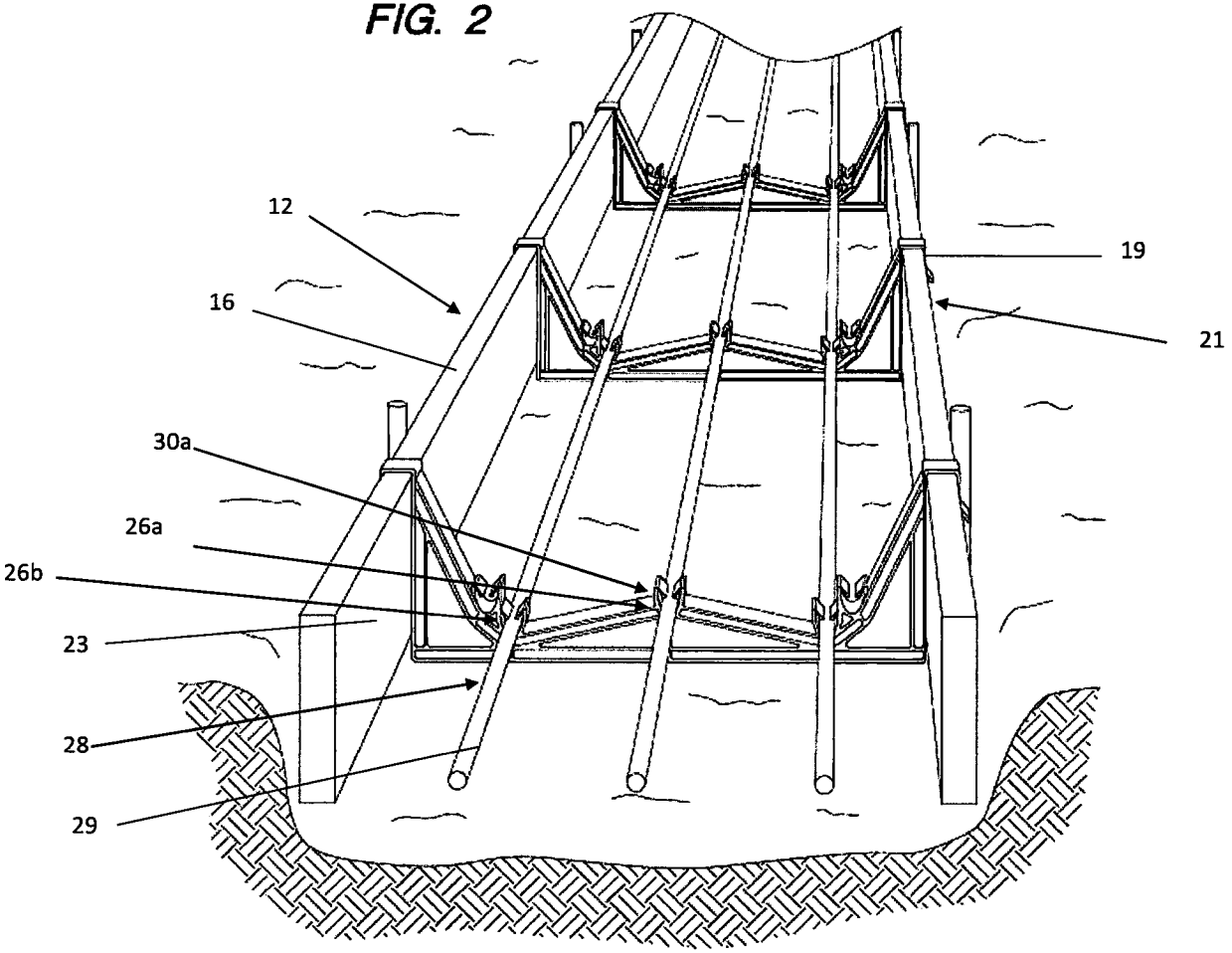
FIG. 2 is an elevated perspective view of the preferred embodiment of the Concrete Form Brace with Multi-Depth Rebar Positioners installed within concrete forms with rebar horizontally positioned.
Figure 3:
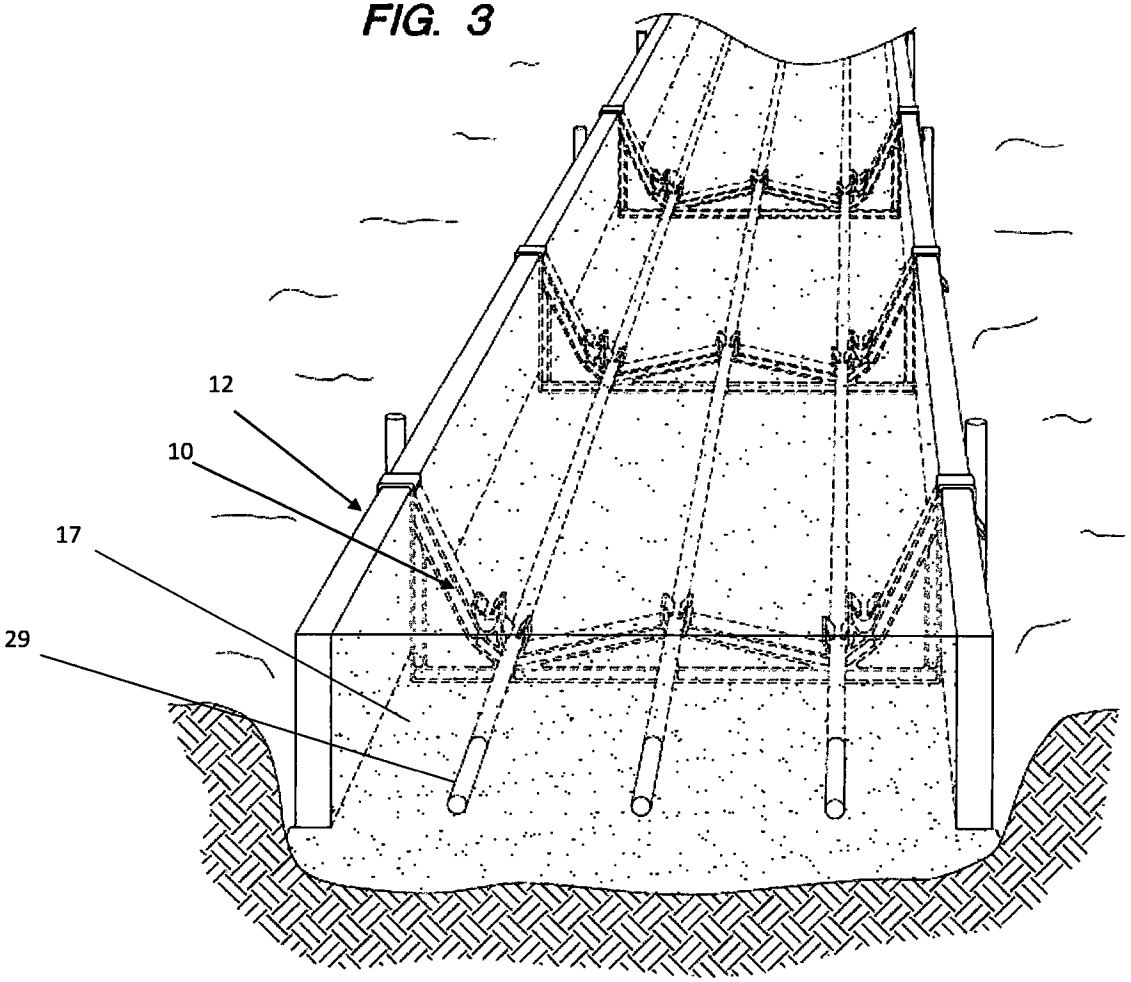
FIG. 3 is an elevated perspective view of the preferred embodiment of the Concrete Form Brace with Multi-Depth Rebar Positioners installed within concrete forms and rebar positioned and concrete poured.

FIGS. 1-4 illustrate the Concrete Form Brace 10. The Concrete Form Brace includes two opposing attachment members 11, which attach the Concrete Form Brace 10 to concrete form elements 12. The attachment members 11 are comprised of a first top end 13, and a second bottom end 14. Said first top end 13 is further comprised of an approximate 90-degree connected horizontal portion 15, which engages the upper horizontal thickness 16 of the concrete form elements 12. Said horizontal portion 15 is generally sized the same as the measured horizontal thickness 16 of the concrete form elements 12 to provide a secure fit of the Concrete Form Brace 10 on the concrete form elements 12. The approximately 90-degree connection 20 between the first top end 13 and horizontal portion 15 can be scored to allow for easily breaking off the horizontal portion 15 once poured concrete 17 has cured. The horizontal portion 15 is further comprised of an approximate 90-degree connection 18 to a downward extending clasping member 19. Said clasping member 19 engages the outside diameter 21 of the concrete form elements 12. The clasping member 19 can include a break off clip 22, which is angled outward from the vertical plane of the outside diameter 21 of the concrete form elements 12. The break off clip 22, provides a convenient purchase for the claw end of a hammer, or any other tool with a claw or hook end to capture the break off clip 22, and break off the horizontal portion 15 at the scored approximately 90-degree connection 20 with a slight upward force applied to the break off clip 22 once the poured concrete 17 has cured. The break off clip can also be struck, which will also break off the horizontal portion 15 at the scored approximately 90-degree connection 20.

The length of the attachment members 11 engage the inside 23 of the concrete form elements 12. The second bottom end 14 of the attachment members 11 include a spanning element 24, which connects the opposing bottom ends 14 of the attachment members 11. The attachment members 11 and spanning element are further connected by a plurality of reinforcing struts 25, which serve to structurally reinforce said Concrete Form Brace 10 and provide attachment points for a plurality of rebar securing mechanisms 26. While the preferred embodiment is demonstrated in FIGS. 1-4, one skilled in the art would appreciate that said plurality of reinforcing struts 25 could be configured in many ways to achieve structural reinforcement and provide multiple attachment points for rebar securing mechanisms 26.

Said rebar securing mechanisms 26 can be incorporated into said reinforcing struts 25 as shown in FIG. 1 at predetermined locations. Or, the rebar securing mechanisms 26 could also be attached to said plurality of reinforcing struts 25 to achieve custom localization by any known attachment means such as glue, clips, ties, etc. In the preferred embodiment, said rebar securing mechanisms 26 are comprised of a concave "U" shaped saddle 27 sized to accept an outside diameter 28 of rebar 29. In the preferred embodiment, the "U" shaped saddle 27 can be sized to accept any standard rebar size. The rebar securing mechanisms 26 are further comprised of opposing rebar securing clasps 30. The rebar securing clasps 30 bend outwardly to allow installed rebar 29 to seat fully within the "U" shaped saddle 27, but then return to their original position once the rebar 29 is fully seated. When the rebar securing clasps 30 are in their original position, the fully seated rebar 29 is secured 30*a* within the rebar securing mechanism 26.

Figure 4:
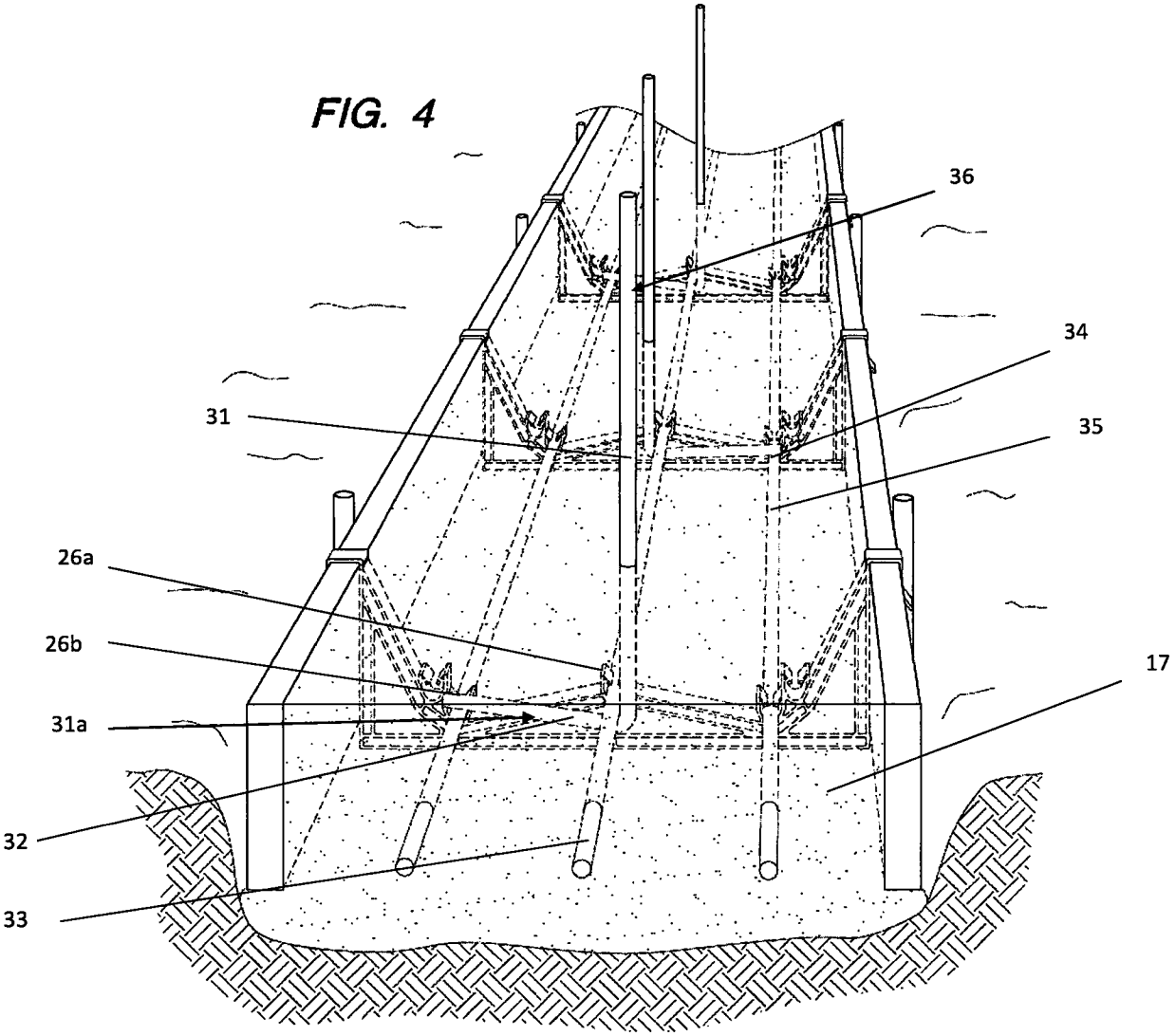
FIG. 4 is an elevated perspective view of the preferred embodiment of the Concrete Form Brace with Multi-Depth Rebar Positioners installed within concrete forms, rebar horizontally positioned, and "L" shaped vertical rebar positioned.

One feature of the preferred embodiment is the ability to quickly and accurately install vertical "L" rebar 31 as demonstrated in FIG. 4. In the preferred embodiment, the vertical spacing between the center rebar securing mechanism 26*a* and lateral rebar securing mechanism 26*b* is equivalent to the outside diameter 31*a* of a vertical "L" shaped rebar 31. In the preferred embodiment, the center rebar securing mechanism 26*a* is elevated compared to the lateral rebar securing mechanism 26*b*. This allows for the foot portion 32 of the vertical "L" rebar 31 to hook under a center horizontal span of rebar 33, which has been secured in the center rebar securing mechanism 26*a*. The distal end 34 of the foot portion 32 of the vertical "L" rebar 31 then rests on a lateral horizontal span of rebar 35. The vertical spacing between the center rebar securing mechanism 26*a* and lateral rebar securing mechanism 26*b* allows for the foot portion 32 of a vertical "L" rebar 31 to be secured perfectly level as shown in FIG. 4. The vertical "L" rebar 31 can be secured to the horizontal spans of rebar by any means including, wire ties, clips, etc. Once secured, the vertically extending portion 36 of the vertical "L" rebar 31 will be maintained in a plumb vertical position while the poured concrete 17 cures.

It is understood that the foregoing examples are merely illustrative of the present invention. Certain modifications of the articles and/or methods may be made and still achieve the objectives of the invention. Such modifications are contemplated as within the scope of the claimed invention.

What is claimed is:

1. A Concrete Form Brace comprising:

a. two opposing attachment members, which attach to concrete form elements, where said opposing attachment members are further comprised of a first top end and a second bottom end, where said first top end is further comprised of an approximate 90-degree connected horizontal portion, which engages an upper horizontal thickness of said concrete form elements, where said approximately 90-degree connection between said first top end and said horizontal portion is scored to allow for breaking off of said horizontal portion once poured concrete has cured;

b. a spanning element, which connects between the bottom ends of said opposing attachment members;

c. a plurality of reinforcing struts, which connect said opposing attachment members and said spanning element;

d. where said plurality of reinforcing struts are further comprised of a plurality of rebar securing mechanisms, where said plurality of rebar securing mechanisms is comprised of a center rebar securing mechanism and at least one lateral rebar securing mechanism; wherein said center rebar securing mechanism is elevated compared to said lateral rebar securing mechanism and vertical spacing between said center rebar securing mechanism and said lateral rebar securing mechanism is equivalent to an outside diameter of rebar, wherein a foot portion of vertical "L" rebar hooks under a center horizontal span of rebar, which has been secured in said center rebar securing mechanism, and a distal end of said foot portion rests on a lateral horizontal span of rebar, which has been secured in said lateral rebar securing mechanism.

2. The Concrete Form Brace of claim 1 where said horizontal portion is further comprised of an approximate 90-degree connection to a downward extending clasping member where said clasping member engages an outside diameter of said concrete form elements.

3. The Concrete Form Brace of claim 2 where said clasping member is further comprised of a break off clip.

4. The Concrete Form Brace of claim 3 where said break off clip is angled outward from a vertical plane of said outside diameter of said concrete form elements.

* * * * *